US007264519B2

(12) United States Patent
Gongwer

(10) Patent No.: US 7,264,519 B2
(45) Date of Patent: Sep. 4, 2007

(54) SAFE EFFICIENT OUTBOARD MOTOR ASSEMBLY

(75) Inventor: Calvin A. Gongwer, Glendora, CA (US)

(73) Assignee: Innerspace Corporation, Covina, CA (US)

( * ) Notice: Subject to any disclaimer, the term of this patent is extended or adjusted under 35 U.S.C. 154(b) by 0 days.

(21) Appl. No.: 11/129,113

(22) Filed: May 13, 2005

(65) Prior Publication Data

US 2006/0258232 A1 Nov. 16, 2006

(51) Int. Cl.
*B63H 11/00* (2006.01)

(52) U.S. Cl. ..... 440/38

(58) Field of Classification Search ..... 440/38
See application file for complete search history.

(56) References Cited

U.S. PATENT DOCUMENTS 4,182,118 A * 1/1980 Chronic ..... 60/221
4,789,306 A * 12/1988 Vorus et al. ..... 416/223 R
5,769,674 A * 6/1998 Stallman ..... 440/38
6,009,822 A * 1/2000 Aron ..... 114/151
6,059,618 A * 5/2000 Purnell et al. ..... 440/38
2003/0036319 A1* 2/2003 Burg ..... 440/38

* cited by examiner

*Primary Examiner*—Stephen Avila
(74) *Attorney, Agent, or Firm*—Steven D. Hemminger; Akin Gump Strauss Hauer & Feld LLP

(57) ABSTRACT

An outboard motor assembly for use as external propulsion for a watercraft includes a drive assembly, a shaft assembly, and a impeller-jet assembly coupled to the shaft assembly. The impeller-jet assembly includes an inlet stator, an exit stator, a impeller, and an external housing surrounding the stators and impeller. The inlet stator contains a plurality of blades, forcing the flow of water into an optimum direction for the impeller. The exit stator also contains a plurality of blades, which are configured to direct the flow from the impeller, removing the twist and resulting in a more efficient flow of water. The exit stator is tapered to create a more efficient flow of water. The center portion of the impeller contains a hub with an exhaust vent. In the alternative, a duct can be positioned adjacent to the outlet stator such that air is directed into the flow from the outlet.

19 Claims, 6 Drawing Sheets

SECTION A–A

SAFE EFFICIENT OUTBOARD MOTOR ASSEMBLY

FIELD OF THE INVENTION

The invention relates generally to propulsion systems including more particularly to a safe efficient outboard motor assembly that can be used with watercraft.

BACKGROUND

FIG. 1 is an illustration of a typical conventional outboard motor assembly 100. An internal combustion engine is contained within an engine housing 104. A drive shaft (not illustrated) located within drive shaft housing 106 couples the engine to a propeller 102. As the engine operates, the drive shaft rotates, causing the propeller 102 to rotate. The rotation of the propeller 102 creates a force which causes the boat to which the outboard motor assembly 100 is attached to move.

Conventionally, certain watercraft use the outboard motor assembly 100 to provide propulsion for the watercraft. The propellers of conventional outboard motor assemblies suffer from a number of disadvantages. The exposed rotating blade presents a danger to native aquatic life and to people. For example, if a person falls off the bow of a moving watercraft, the person may be dragged under the watercraft into the path of the rotating propeller 102. While there have been attempts at creating guards that encompass the propeller, such guard/propeller assemblies have typically resulted in an undesirable decrease in performance.

In addition, cavitation caused by the spinning propeller of conventional outboard motor assemblies creates inefficiencies that can result in less thrust being produced than is optimal. At certain propeller speeds, the created cavitation results in a forward speed limit, beyond which creating additional thrust is impracticable since it does not result in any meaningful improvement in the speed of the craft.

The present invention addresses the above and other problems.

BRIEF SUMMARY

The present invention includes several novel aspects all of are described herein. One embodiment of and aspect of the present invention preferably includes a drive assembly, a shaft assembly, and a impeller-jet assembly coupled to the shaft assembly. A preferred impeller-jet assembly preferably includes an inlet stator, an exit stator, a propeller, and an external housing surrounding the stators and the propeller. The ends of the blades of the propeller are not exposed to human and marine life, resulting in a safer means of propelling a watercraft. The inlet stator preferably includes a plurality of blades shaped to direct the flow of water into an optimum direction for the propeller. The exit stator also preferably contains a plurality of blades shaped to minimize the rotation of the water imparted by the propeller and develop a more efficient flow of water as it exits the impeller-jet assembly.

In one embodiment, the external housing is preferably tapered at the exit stator, such that the radial width of the annular nozzle flow passage decreases in the radial direction as the water travels from the nozzle inlet to its exit.

BRIEF DESCRIPTION OF THE DRAWING FIGURES

A more complete understanding of the present invention may be derived by referring to the detailed description and claims when considered in connection with the following illustrative figures, which may not be to scale. In the following figures, like reference numbers refer to similar elements.

DETAILED DESCRIPTION

Figure 1:
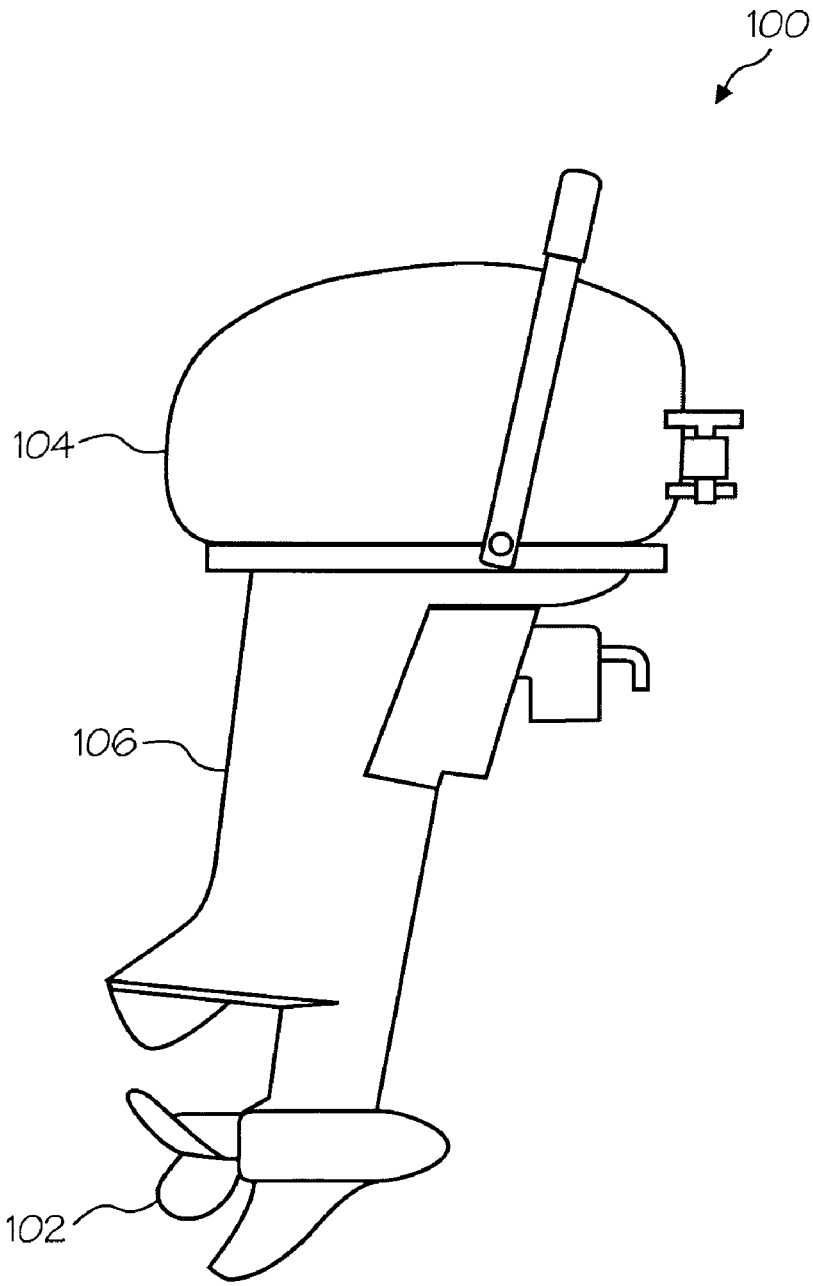
FIG. 1 is an illustration of a typical conventional outboard motor assembly.

In the following description, for purposes of explanation, numerous specific details are set forth that provide a thorough understanding of aspects and embodiments of the present invention. It will be apparent, however, that all of these specific details may not be required to practice the inventions set forth in the claims and that variants of the details can be substituted for many of the specifics to meet the details of the specific application in which the invention may be used.

In the following description of the preferred embodiments, substantially similar parts are denoted by the same reference numerals. Also, while references such as top, bottom, side, horizontal, and vertical may be used throughout the specification, it is to be understood that their orientation requirements are only to facilitate the explanation of the various embodiments and depending on the application, the top could be the side or bottom or vice versa.

With reference to FIGS. 2, 3, 4, 5, and 6, an embodiment and aspects of the present invention will now be described.

Figure 2:
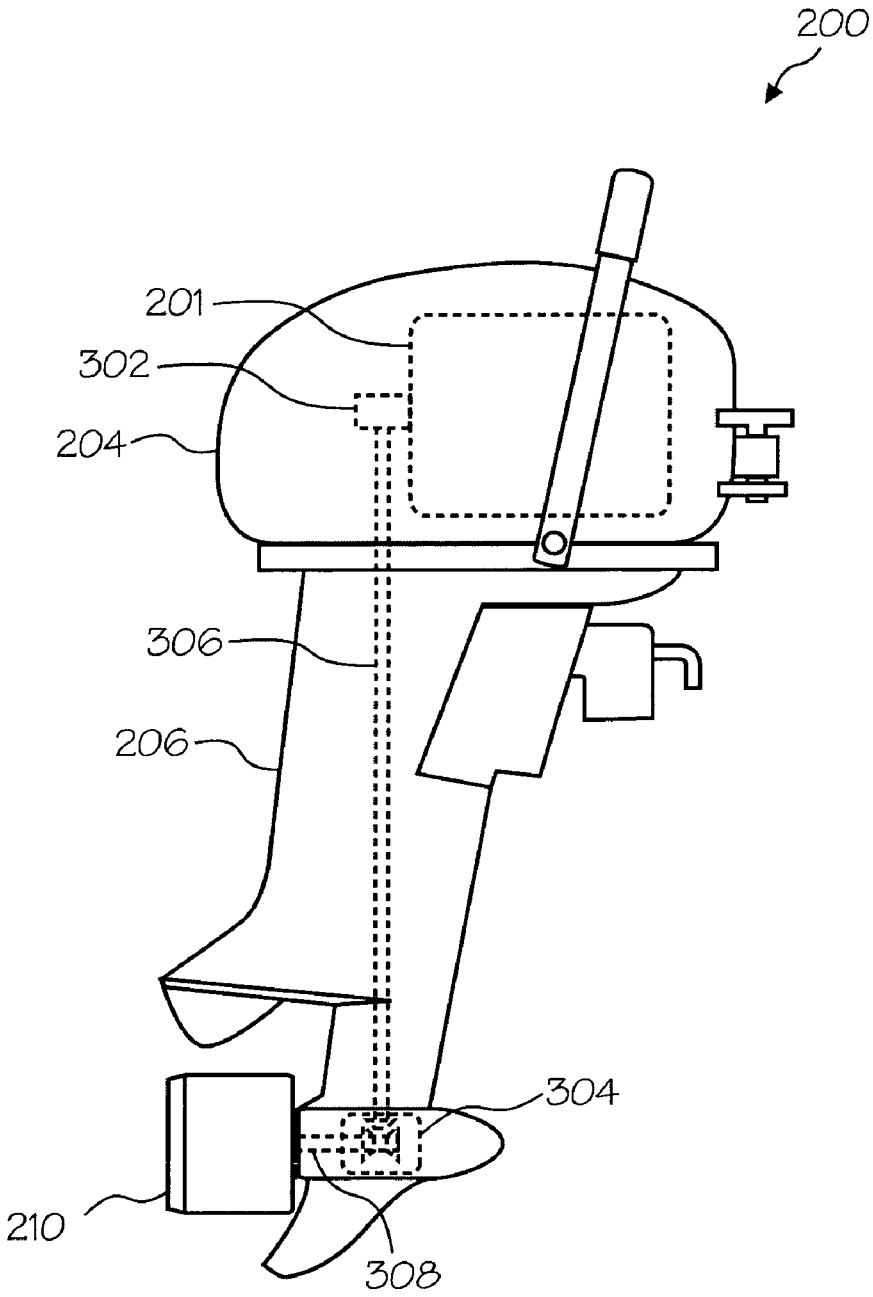
FIG. 2 is an embodiment of one aspect of the present invention.

FIG. 2 is an illustration of one embodiment of the present invention. The novel safe outboard motor assembly depicted in FIG. 2 includes an internal combustion engine 201 contained within an engine housing 204. A shaft assembly is coupled to the internal combustion engine 201. The shaft assembly may have one of a variety of different configurations. For example, the shaft assembly may preferably include a shaft coupler 302, a gear assembly 304, transmission shaft 306, and a drive shaft 308. The shaft coupler 302 couples the internal combustion engine 201 with the transmission shaft 306 such that the rotational output of the internal combustion engine 201 causes the transmission shaft 306 to turn. The transmission shaft 306 is located within drive shaft housing 206 and is preferably coupled via a gear assembly 304 to a drive shaft 308. The gear assembly 304 connects the transmission shaft 306, which is preferably oriented in a primarily vertical orientation, to the drive shaft 308, which is preferably oriented in a primarily horizontal orientation. Through use of the gear assembly 304, the rotation of the transmission shaft 306 results in rotation of the drive shaft 308. Coupled to the drive shaft 308 is impeller-jet assembly 210. The operation of impeller-jet assembly 210 creates a force which causes the boat to which novel outboard motor assembly 200 is attached to move.

Figure 3:
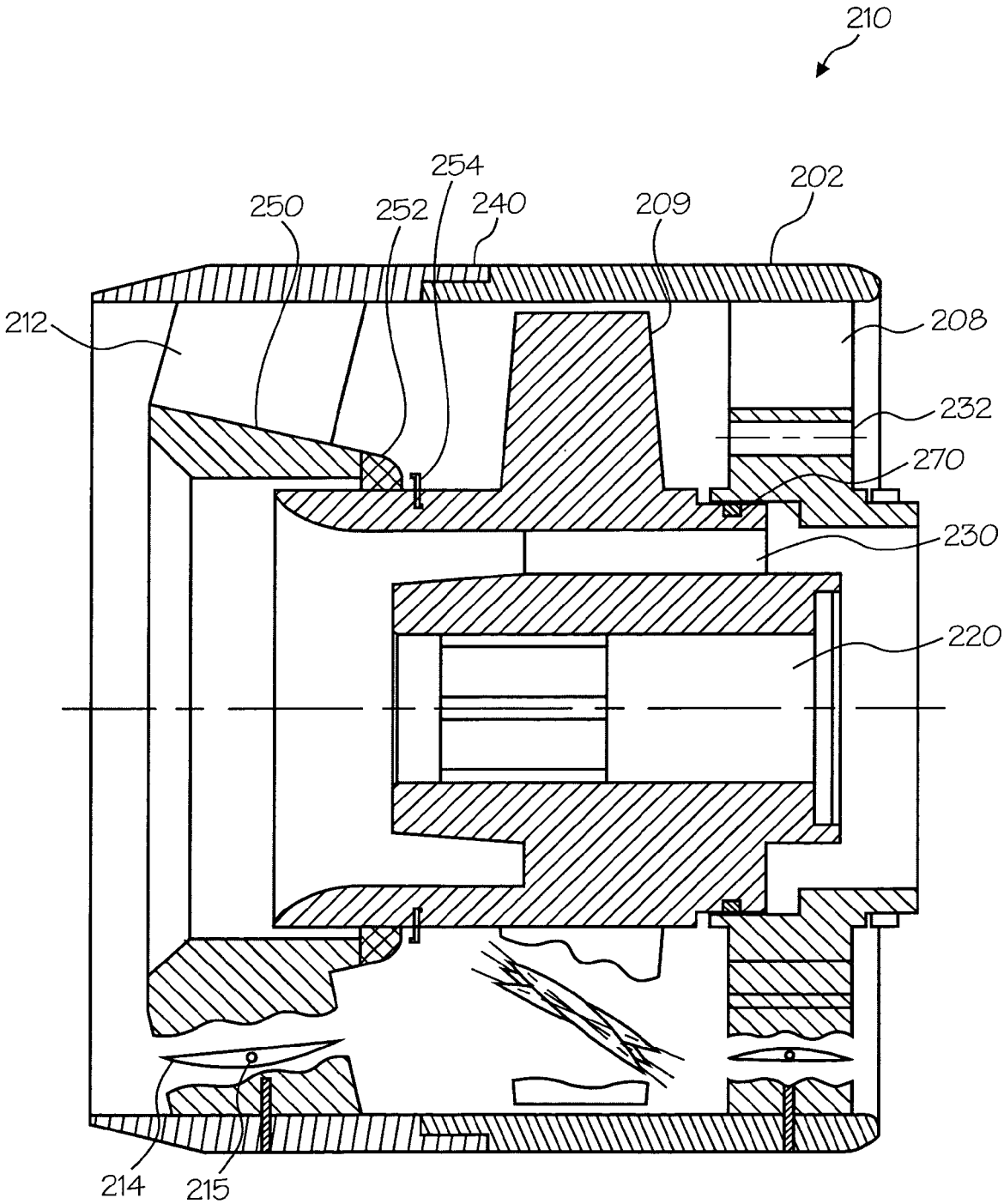
FIG. 3 is a cross-section of an embodiment of the impeller-jet aspect of the present invention.
Figure 4:
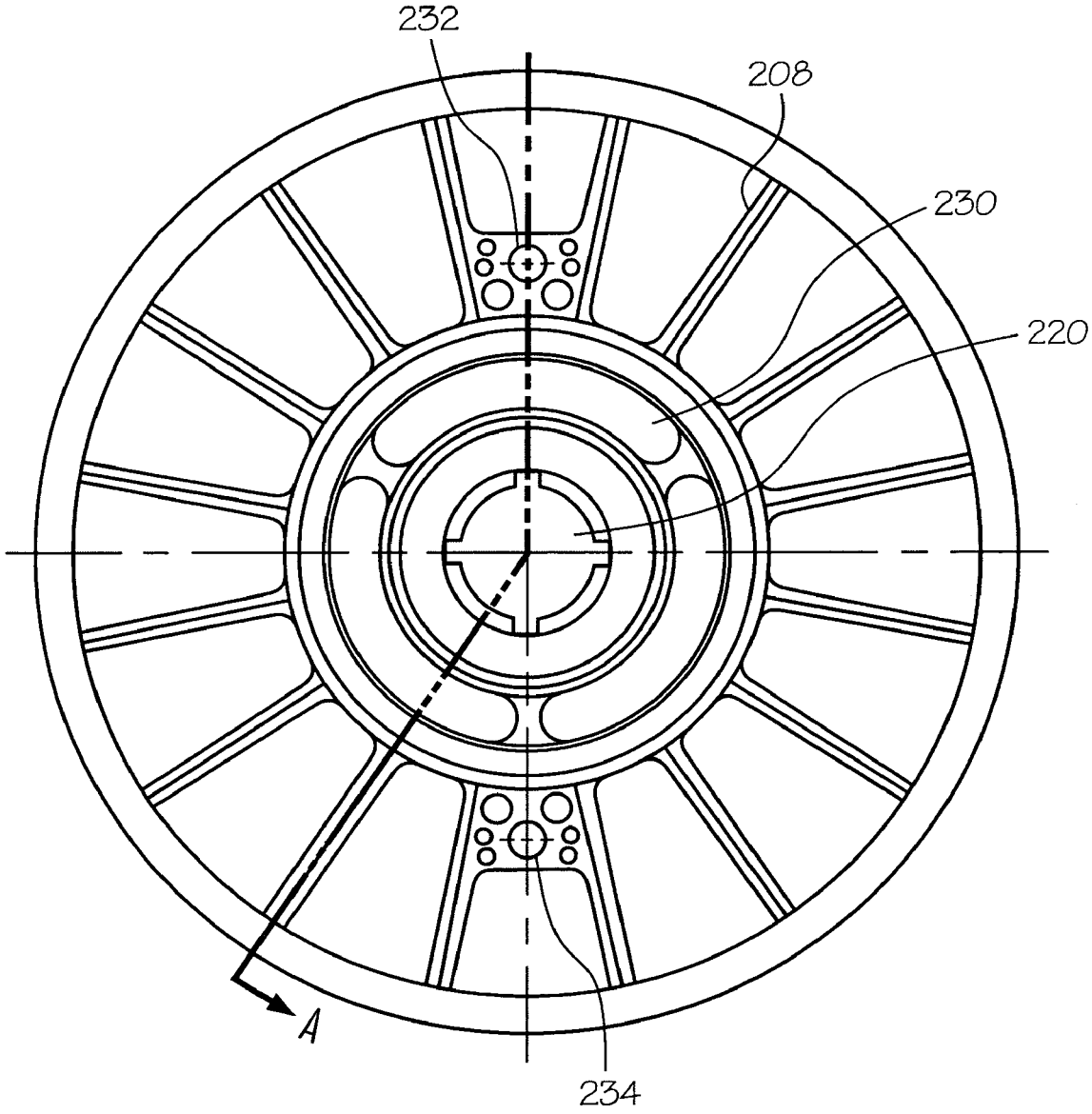
FIG. 4 is a view from the inlet side of the impeller-jet aspect of the present invention.
Figure 5:
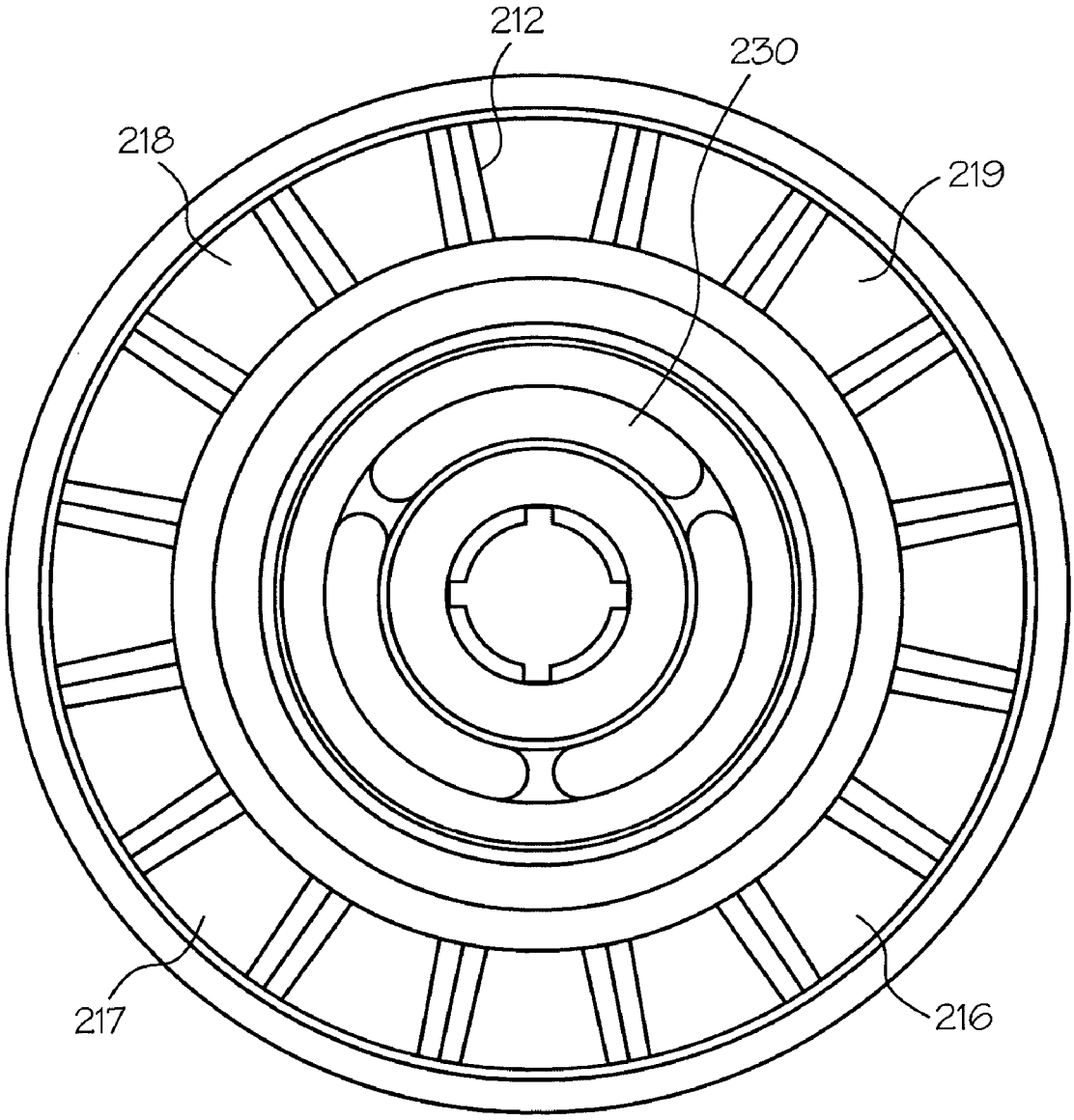
FIG. 5 is a view from the outlet side of the impeller-jet aspect of the present invention.

With reference to FIGS. 3, 4, and 5, the details of impeller-jet assembly 210 will be described in more detail. FIG. 3 is a cross-section drawing of a preferred embodiment of the impeller-jet assembly, taken along the line A-A shown in FIG. 4. FIG. 4 is a view from the inlet side of the impeller-jet assembly depicted in FIG. 3 and FIG. 5 is a view from the outlet side of the impeller-jet assembly depicted in FIG. 3. FIG. 3 is oriented such that the inlet side, also known as the leading edge (the edge that travels through the water first) of impeller-jet assembly 210 is to the right side of the figure and the outlet side or trailing edge is to the left side of the figure.

Impeller-jet assembly 210 is preferably rotatably coupled to the drive shaft 308 in a conventional manner. The stationary portions of the impeller-jet assembly 210 can be connected to the shaft housing 206 by a variety of different means. In the illustrated embodiment, bolt holes 232 and 234, located on inlet stator 208, accept fasteners that allow assembly 200 to be securely attached to the connecting shaft housing portion of the shaft housing. Such fasteners may be any of a variety of different fasteners, such as bolts being used in conjunction with washers and nuts. Alternatively, impeller-jet assembly 200 may be permanently attached to the connecting shaft housing by welding or other method.

In the preferred embodiment, inlet stator 208 supports an external housing 202. External housing 202 may be constructed from a variety of different materials. In one preferred embodiment, external housing 202 is constructed from PVC pipe. External housing 202 may comprise a single piece of PVC pipe. In another embodiment, external housing 202 comprises two separate pieces of PVC that are joined together at a lap joint 240. The use of two separate pieces of PVC allows one to remove one of the pieces of PVC to facilitate maintenance of assembly 210. Lap joint 240 may be secured by one of a variety of different manners, such as by screws or bolts.

As shown in FIG. 3, one embodiment of enclosed impeller-jet assembly 210 features an external housing 202 with a tapered trailing edge. Such a taper allows the flow of water to pass around external housing 202 with less drag.

Inlet stator 208, in conjunction with external housing 202, serves to protect people and marine life from impeller 206, which rotates at a high rate of speed. In addition, inlet stator 208 can be configured to direct the flow of water in a particular direction. It may be desirable to direct the incoming flow in the direction of rotation as impeller 206 or otherwise prevent a twist in the incoming water flow. In one embodiment, inlet stator 208 contains 16 blades. In one embodiment, if impeller 206 has an odd number of blades, it is preferable for inlet stator 208 and exit stator 212 to have an even number of blades. Similarly, if impeller 206 has an even number of blades, it is preferable for inlet stator 208 and exit stator 212 to each have an odd number of blades. Such a configuration results in a reduction in mutual interference.

A hub 220 supports impeller 206. Hub 220 serves to couple the drive shaft 308 to the impeller 206. The internal combustion engine 201 causes the drive shaft to rotate, in turn causing impeller 206 to rotate, which provides thrust to the watercraft.

Impeller 206 may be any type of impeller known in the art. However, impeller 206 preferably has certain characteristics may result in a more efficient assembly when used in an embodiment of the present invention. For example, when a impeller is enclosed in an embodiment of the present invention, it is more desirable to have an impeller with more blades. In one preferred embodiment, the impeller contains 17 or 24 blades.

The pitch of an impeller is defined as the distance that the impeller would move in one revolution if it were moving through a soft solid. The pitch may be calculated as follows:

$$\text{Pitch}=\pi * D * \tan(\phi),$$

where D is the diameter of the impeller and $\phi$ is the impeller section blade tip angle with the tangential direction. In a preferred embodiment of the present invention, the pitch is relatively high in comparison to impellers in conventional outboard motor assemblies. In one embodiment, the ratio of the pitch to the diameter of impeller 206 is approximately between 2 and 5.

In an embodiment of the present invention, impeller 206 may also have a high solidity. Solidity is defined as the axially projected blade area as a fraction of the impeller's swept disc. In a preferred embodiment of the present invention, the solidity of impeller 206 may range from 75% to over 100%. In addition, impeller 206 preferably has a ratio of hub diameter to tip diameter of between 40 and 60%.

An exit stator 212 is coupled to external housing 202. Exit stator 212 serves several different purposes. Exit stator 212 serves to straighten the flow of water from the impeller 206. In conventional outboard motor assemblies with an exposed propeller, the propeller twists the flow of water as the propeller rotates. Such a twist creates inefficiencies because the force generated by the propeller is not parallel to the axis of the propeller. Exit stator 212 preferably contains multiple blades that serve to remove the twist, creating a more efficient flow of fluid. The blades of the exit stator 212 may be tapered, such that each blade is thinner at the trailing edge than at the leading edge.

In a preferred embodiment of the present invention, the exit nozzles 216 formed by the exit stator 212 are tapered—the nozzle reduces in width from the entrance to the exit. One such configuration is shown in FIG. 3. Such a configuration stabilizes the flow through the exit nozzles and suppresses flow separation or stall and cavitation on the vanes in the nozzle. In one preferred embodiment, the area of the nozzle at the exit is approximately 50% of the through-flow area of the nozzle at its entrance. Such a configuration is illustrated in FIG. 3. Exit stator 212 has an inner boundary surface 250 that is not parallel to external housing 202. At the leading edge (closer to the impeller 206), inner boundary surface 250 is farther away from external housing 202 than at the trailing edge. In one embodiment, if a distance X represents the distance from the inner boundary surface 250 to the external housing 202 at the leading edge, then the distance (X/2) represents the distance from the inner boundary surface 250 to the external housing 202 at the trailing edge, resulting in the area of the nozzle being approximately 50% of the area at the leading edge.

In another preferred embodiment, there is a reed valve 214 located within some of the exit nozzles 216. In one embodiment, the reed valves 214 are located in the exit nozzles 216, 217, 218, and 219. The reed valve 214 is shaped such that, at high flow rates, the reed valve 214 automatically rotates about a pivot 215, closing under the higher pressure, closing the exit nozzle and further reducing the exit flow cross section, suppressing cavitation and limiting the effect of cavitation on performance.

In an embodiment of the present invention the water jet formed by exit stator 212 is annular. Such a ring-shaped water jet may result in a vacuum being formed in the center of the water jet, reducing the thrust being produced.

To address this, preferably exhaust gases from the engine are ventilated through hub 220 in an embodiment of the present invention. A vent 230 extends the length of assembly 210, from hub 220 to an exit near exit stator 212. Exhaust gases are ventilated through vent 230 into the water. The ventilation of exhaust gases is at or near ambient pressure (approximately one atmosphere). By ventilating the exhaust gases adjacent to exit stator 212, the base drag on the circular area inside the annular nozzle closure of reed valves 214 is minimized.

An O-ring 270 couples inlet stator 208 and impeller 206. O-ring 270 serves to prevent exhaust gases from leaking from vent 230 to impeller 206. O-ring 270 also prevents water from flowing from inlet stator 208 and impeller 206 to vent 230. O-ring 270 allows impeller 206 to float within inlet stator 208, such that impeller 206 can move independently from inlet stator 208.

A washer 252 couples the inner boundary surface 250 of exit stator 212 to the impeller 206. Washer 252 directs water from the impeller 206 to the exit stator 212. In such a manner, the flow leakage from the clearance between the inner boundary surface 250 and the impeller 206 is minimized.

A washer 252 may be configured out of a variety of different materials. For example, the washer 252 may be constructed from rubber or plastic. The washer 252 may be securely attached to either the inner boundary surface 250 or the impeller 206. In another embodiment, the washer 252 floats and is not attached to any surface. The force of the flow from the impeller 206 forces the washer 252 against the inner boundary surface 250. When the engine is used in a reverse mode, the flow of water may force the washer 252 in the opposite direction-towards the impeller 206. To prevent the washer 252 from interfering with the impeller 206, a stopper 254 may be secured to the impeller 206 to prevent the washer 252 from moving towards the impeller 206. The stopper 254 may be formed in a variety of different manners. In one embodiment, the stopper 254 is welded directly to the impeller 206.

Figure 6:
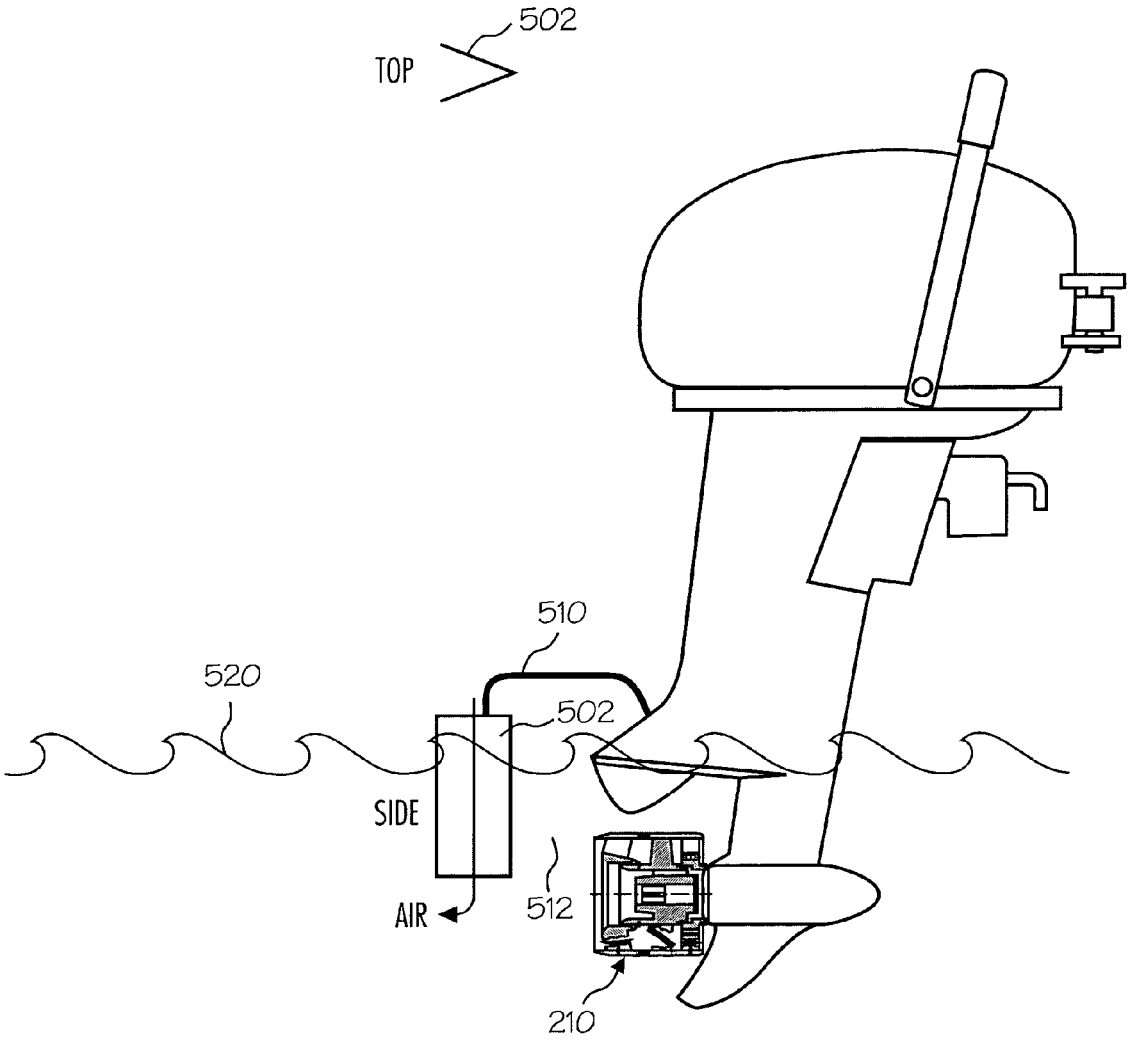
FIG. 6 is an illustration of an alternative embodiment the impeller-jet aspect of the invention including an air supply duct.

In an alternative embodiment, an external duct can direct the gases through the wall of the cylindrical propulsion jet to alleviate any vacuum which might form due to the jet pump effect of the annular jet. With reference to FIG. 6, an air supply duct 502 is provided at the exit of assembly 200. Air supply duct 502 extends above the border between the air and water 512. Air supply duct 502 operates to direct air flow from above the waterline 520 to exit 504 of duct 502. Exit 504 is positioned near the exit of assembly 200. In one embodiment, air supply duct 502 is a V-shaped channel, where the vertex is directed towards the bow of the watercraft. The V-shape allows duct 502 to produce less drag than other shapes, while also directing a flow of air down towards exit 504. The air flow created by air supply duct 502 reduces or eliminates the vacuum present in the area inside the annular nozzle.

Air supply duct 502 may be positioned and secured in a variety of different manners. In one embodiment, air supply duct 502 is coupled to an outboard motor assembly via a holder 510 such that exit 504 is positioned adjacent to assembly 210. Holder 510 may be one of a variety of different configurations. For example, holder 510 may be constructed out of a corrosion resistant metal, attached to both air supply duct 502 and the outboard motor. Air supply duct 502 may be coupled to the holder 510 through the use of screws, rivets, or any other fastener now known and developed in the future.

Thus, the base drag on the circular area inside the annular nozzle is eliminated.

There are several advantages of this embodiment of the present invention. impeller-jet assembly 210 is more efficient than conventional outboard motor assemblies. For example, a 13-inch diameter propeller in a conventional outboard motor assembly can be replaced by a impeller-jet assembly 210 with an 8-inch diameter. Thus, a smaller assembly can be used while still achieving the same performance, resulting in a space savings. In addition, unlike jet drive units used in jet skis, a impeller-jet assembly 210 can be easily retrofitted into an existing watercraft.

The present invention has been described above with reference to a preferred embodiment. However, changes and modifications may be made to the preferred embodiment without departing from the scope of the present invention. For example, while the apparatus was described as being for use with outboard motor assemblies, it should be understood that the apparatus can be used in systems where the watercraft's engine is inboard. Moreover, no element is essential to the practice of the invention unless specifically described herein as "critical" or "essential". These and other changes or modifications are intended to be included within the scope of the present invention, as expressed in the following claims.

I claim:

1. An outboard motor assembly comprising:

a mounting bracket for mounting the outboard motor assembly on a watercraft;

an internal combustion motor housed in a motor housing;

a shaft assembly housed in a shaft housing said shaft assembly comprising a motor coupling, a transmission shaft, a gear assembly, and a drive shaft;

an impeller-jet assembly, said impeller-jet assembly comprising:

an inlet stator;

an external housing attached to said inlet stator;

an impeller configured to rotate within said external housing; and an exit stator attached to said external housing; wherein said motor coupling is coupled to said internal combustion motor such that said internal combustion motor causes said transmission shaft to rotate in the desired direction;

said gear assembly is mounted between said transmission shaft and said drive shaft such that rotational motion is transferred from the said transmission shaft to said drive shaft;

further wherein when said outboard motor assembly is mounted on a watercraft to propel said watercraft, said transmission shaft is oriented in a mostly vertical direction and said drive shaft is oriented in a mostly horizontal direction;

further wherein said impeller-jet assembly is coupled to said drive shaft such that the rotation of said drive shaft causes the rotation of said impeller-jet assembly; and further wherein said housing comprises a step-less outer surface.

2. The apparatus of claim 1 wherein:

said inlet stator is segmented via a plurality of inlet blades; and further wherein said inlet stator is configured to direct the flow of water in the direction of rotation of said impeller.

3. The apparatus of claim 1 wherein:

said exit stator is segmented via a plurality of outlet blades.

4. An outboard motor assembly comprising:

a mounting bracket for mounting the outboard motor assembly on a watercraft;

an internal combustion motor housed in a motor housing;

a shaft assembly housed in a shaft housing said shaft assembly comprising a motor coupling, a transmission shaft, a gear assembly and a drive shaft;

an impeller-jet assembly, said impeller-jet assembly comprising:

an inlet stator;

an external housing attached to said inlet stator;

an impeller configured to rotate within said external housing; and an exit stator attached to said external housing; wherein said motor coupling is coupled to said internal combustion motor such that said internal combustion motor causes said transmission shaft to rotate in the desired direction;

said gear assembly is mounted between said transmission shaft and said drive shaft such that rotational motion is transferred from the said transmission shaft to said drive shaft;

further wherein when said outboard motor assembly is mounted on a watercraft to propel said watercraft, said transmission shaft is oriented in a mostly vertical direction and said drive shaft is oriented in a mostly horizontal direction;

further wherein said impeller-jet assembly is coupled to said drive shaft such that the rotation of said drive shaft causes the rotation of said impeller-jet assembly;

further wherein said exit stator is segmented via a plurality of outlet blades; and further wherein each of said plurality of outlet blades tapers such that the leading edge of each blade is thicker than the trailing edge of each blade.

5. The apparatus of claim 4 wherein said impeller contains 17 blades.

6. The apparatus of claim 4 wherein said impeller contains 24 blades.

7. The apparatus of claim 1 wherein a ratio of the pitch of said impeller blade to said impeller blade diameter is between 2 and 5.

8. The apparatus of claim 1 wherein the ratio of hub diameter to tip diameter of said impeller is approximately 0.5.

9. The apparatus of claim 1 further comprising:

an O-ring seal located between said impeller and said inlet stator; and a washer coupled between said impeller and said exit stator.

10. The apparatus of claim 1 further comprising:

a sealing ring coupled between said impeller and said exit stator.

11. The apparatus of claim 1 further comprising:

a reed valve located between two blades of said exit stator, said reed valve configured to close when the pressure of fluid flowing across said reed valve exceeds a predetermined limit.

12. The apparatus of claim 1 wherein said exit stator is configured such that the cross-section area of the flow passage at the stator exit is approximately 50% of the area at its entrance.

13. The apparatus of claim 1 further comprising:

a hub coupled to said impeller; and wherein said hub contains a vent through which exhaust gases can be transported; and further wherein the venting of the exhaust gases relieves the otherwise occurring negative pressure over the hub area inside the annular water jet.

14. The apparatus of claim 1 wherein said external housing tapers such that said external housing has a greater thickness at its rounded leading edge than at its trailing edge.

15. The apparatus of claim 1 further comprising:

an air supply duct comprising an inlet and an outlet positioned adjacent to said external housing, wherein said outlet is positioned adjacent to said exit stator, and wherein said inlet is positioned so as to direct atmospheric air to said outlet.

16. The apparatus of claim 15 wherein said air supply duct is a V-shaped channel.

17. An outboard motor assembly comprising:

means for mounting the outboard motor assembly on a watercraft;

means for producing a rotational motion;

an impeller-jet assembly, said impeller-jet assembly comprising:

an inlet stator;

an external housing attached to said inlet stator;

an impeller configured to rotate within said external housing;

an exit stator attached to said external housing; and means for coupling the impeller-jet assembly to the means for producing rotational motion; wherein said housing comprises a step-less outer surface.

18. The apparatus of claim 17 further comprising: means for directing atmospheric air to the vicinity of said impeller-jet assembly.

19. The apparatus of claim 17 wherein said exit stator is segmented via a plurality of outlet blades; and further wherein each of said plurality of outlet blades tapers such that the leading edge of each blade is thicker than the trailing edge of each blade.

* * * * *